US010563467B2

(12) United States Patent
Nelsen et al.

(10) Patent No.: US 10,563,467 B2
(45) Date of Patent: Feb. 18, 2020

(54) APPARATUS FOR HANDLING A BLOWOUT PREVENTER STACK

(71) Applicant: Nelsen Technologies Inc., Sherwood Park (CA)

(72) Inventors: Blair Nelsen, Sherwood Park (CA); Cody Gunderson, Sherwood Park (CA)

(73) Assignee: Nelsen Technologies Inc., Sherwood Park (CA)

( * ) Notice: Subject to any disclaimer, the term of this patent is extended or adjusted under 35 U.S.C. 154(b) by 239 days.

(21) Appl. No.: 15/598,775

(22) Filed: May 18, 2017

(65) Prior Publication Data

US 2017/0335637 A1 Nov. 23, 2017

Related U.S. Application Data

(60) Provisional application No. 62/339,625, filed on May 20, 2016.

(51) Int. Cl.

| | |
|---|---|
| ***E21B 19/00*** | (2006.01) |
| ***B66C 1/44*** | (2006.01) |
| *E21B 33/068* | (2006.01) |
| *E21B 33/06* | (2006.01) |

(52) U.S. Cl.

CPC ..... *E21B 19/00* (2013.01); *B66C 1/44* (2013.01); *E21B 33/06* (2013.01); *E21B 33/068* (2013.01)

(58) Field of Classification Search

CPC ..... E21B 19/00; E21B 33/068

See application file for complete search history.

(56) References Cited

U.S. PATENT DOCUMENTS

| | | | | |
|---|---|---|---|---|
| 4,398,598 | A | 8/1983 | Fabrygel | |
| 4,453,884 | A | 6/1984 | Gudgel | |
| 4,630,347 | A | 12/1986 | Chilton | |
| 5,662,181 | A * | 9/1997 | Williams | E21B 33/085 166/84.3 |
| 7,040,411 | B2 | 5/2006 | Kainer et al. | |
| 7,497,268 | B1 * | 3/2009 | Zeni | E21B 19/06 166/379 |
| 2014/0265389 | A1 | 9/2014 | Orgeron | |

* cited by examiner

*Primary Examiner* — Robert E Fuller

(74) *Attorney, Agent, or Firm* — Klarquist Sparkman, LLP

(57) ABSTRACT

A clamp for attachment to a blow out preventer (BOP) stack for lifting and/or maneuvering the BOP stack and a method for attaching the clamp to the BOP stack is described. The clamp is formed from a first and second clamp half which are connected together using male and female connectors located at inner mating surfaces of the clamp halves, and locking connectors located at the outer edge of the clamp halves. The clamp includes at least two connection points for attaching the clamp and/or clamp halves to lifting devices for moving each clamp half and/or the whole clamp and BOP stack.

20 Claims, 10 Drawing Sheets

APPARATUS FOR HANDLING A BLOWOUT PREVENTER STACK

CROSS-REFERENCE TO RELATED APPLICATIONS

This application claims the benefit of U.S. Provisional Application Ser. No. 62/339,625 filed on May 20, 2016, the entire disclosure of which is incorporated herein by reference in its entirety.

FIELD OF THE INVENTION

The invention relates to the safe handling and maneuvering of blow out preventer (BOP) stacks in the oilfield, and more specifically to a lifting apparatus/clamp for maneuvering BOP stacks.

BACKGROUND

A blowout preventer (BOP) is a large, specialized valve or similar mechanical device that is used to seal, control and monitor oil and gas wells, including land wells, offshore rigs and subsea wells. BOPs are designed primarily to cope with extreme erratic pressures and uncontrolled flow (formation kick) emanating from a well reservoir during drilling to prevent blowouts (i.e. the uncontrolled release of oil and gas at high pressure from a wellbore) and to prevent tubing, tools and drilling fluid from being blown out of the wellbore. BOPs are required at every wellhead during drilling for safety reasons, and are the last line of defense in preventing blowouts.

Typically a BOP stack is used, which is an assembly of several stacked BOPs of varying function and type, and is also referred to as a stack or a BOP. There are two general types of BOPs: annular and ram. A typical BOP stack usually has at least one annular BOP stacked above several ram BOPs, along with auxiliary components such as electrical and hydraulic lines. On land rigs, a BOP stack may have a bore diameter of 13" or greater and be rated for working pressure up to and exceeding 10,000 psi. A BOP stack may be tens of feet tall and weigh tens of thousands of pounds.

The size and weight of a BOP stack provides several challenges to lifting, lowering, and transporting a BOP stack to or from the wellhead. Installing a BOP stack on a wellhead is particularly challenging and is a time consuming operation requiring fine movements. First the stack must be positioned beneath the drill floor and directly over a wellhead, centered on the axis of the well, which typically requires fine adjustment of the BOP stack along a horizontal axis and possibly a vertical axis. Since the BOP stack generally connects to the wellhead by a flange, the BOP stack must be rotated about its vertical axis to align the bolt patterns on the BOP stack flange with the casing bowl bolt patterns at the wellhead.

BOP handling systems typically comprise an overhead lifting system, such as a crane or trolley, to lift a BOP off a skid and transport it to the wellhead. There are many safety risks with handling such a large, heavy piece of equipment, especially because there are generally people working on, near or under the BOP stack while it is being handled. Weather conditions, such as high wind velocities, can also increase the risks associated with handling BOP stacks.

BOP stacks are not generally manufactured to include a mechanism for handling the BOP, so typically an aftermarket clamp is attached to the BOP stack to provide attachment points for the handling system. Most handling systems are top-supporting systems that hoist the BOP stack from an overhead device.

BOP clamps are typically installed around the BOP stack under the top annular BOP. Most clamps are comprised of two pieces that are bolted together around the BOP stack, which allows the clamp to be secured to the BOP stack without removing the annular BOP. The use of bolts for securing the clamp together raises safety issues since most clamps are not installed by mechanics but by workers who may not understand and use proper bolt torque techniques and values. Additionally, bolts can go missing and improper grades of bolt materials can be used. This can create serious safety problems when used for handling a highly loaded overhead item like a BOP stack. Furthermore, BOP clamps often extend up the side of an annular BOP and interfere with hydraulic and electrical lines, resulting in the clamps and/or lines having to be modified in the field. Not only is this time-consuming, but it also creates safety risks if the clamps and/or hydraulic/electrical lines are used in an unintended manner.

U.S. Patent Publication No. 2014/0265389 provides a BOP lifting apparatus comprising a frame with a U-shaped central recess that fits around a BOP stack, and a pivotable gate attached to the frame that can be opened or closed around the BOP stack using an actuator.

U.S. Pat. No. 7,040,411 provides a BOP handling system comprising a cart/skid, a tilting frame and a lifting frame to allow for movement of a BOP stack from a horizontal position to a vertical position. This handling system does not allow for lifting the BOP stack in a vertical direction which is often needed for moving and changing around BOP stacks at a well.

U.S. Pat. No. 4,630,347 discloses a hydrant tool assembly for installing or removing a seat ring and valve from a hydrant shoe located beneath the hydrant. The tool assembly includes a two piece gripper clamp for locking the upper and lower barrels of the hydrant together. The clamp is not designed for lifting functions, nor for supporting a heavy load such as a BOP stack.

There is a need for a BOP handling system/clamp that is compact and can efficiently and effectively attach to a BOP stack without having to disassemble the BOP stack and without interfering with the structure of the BOP stack. There is a further need for a BOP handling system/clamp that can support the load of a BOP stack to lift the BOP stack.

SUMMARY

In accordance with the invention, there is provided a clamp for attachment to a BOP stack and a method for attaching a clamp around a BOP stack to enable lifting and/or maneuvering of the BOP stack.

In one aspect of the invention, there is provided a clamp for attachment to a blow out preventer (BOP) stack for lifting and/or maneuvering the BOP stack, the clamp comprising a first clamp half and a second clamp half for operative connection to each other to form the clamp, each clamp half having an inner edge with a generally arcuate recess and an inner mating surface adjacent each side of the generally arcuate recess, wherein the generally arcuate recess and inner mating surfaces of each clamp half align opposing each other to form an opening in the clamp for enclosing the BOP stack, wherein each clamp half includes at least one male or female connector at each inner mating surface for joining with the at least one male or female connector at the opposing inner mating surface of the other clamp half; at least one locking connector located near each inner mating surface, wherein the locking connectors of the clamp halves align with each other to secure the clamp halves together; and at least two connection points on the clamp half for operative connection to a lifting device for lifting and/or maneuvering the clamp half and/or the clamp and BOP stack.

The at least one male or female connector on each clamp half may be a dowel pin or dowel pinhole, respectively. The at least one locking connector may be a lug that can receive a retainer pin for securing the lugs of each clamp half together.

The at least two connection points may comprise a primary connector on each clamp half for use during lifting and maneuvering of the clamp and BOP stack when the clamp is secured around the BOP stack. The at least two connection points may also comprise at least two secondary connectors on each clamp half for use during lifting and maneuvering of the clamp half when it is not secured to the other clamp half. The at least two secondary connectors may be positioned on the clamp half to allow for generally even distribution of the weight of the clamp half between the at least two secondary connectors.

The clamp may further comprise a lifting adaptor connected to at least one of the at least two connection points for changing an angle and/or position of connection and/or the number of connection points.

The clamp may further comprise a platform for removable connection to the clamp for accessing the BOP stack when the clamp and platform are connected.

The clamp may further comprise a staircase or ramp connected to the platform.

At least the first clamp half or at least the second clamp half may include one or more drain holes in its bottom surface.

In another aspect of the invention, there is provided a method for attaching a clamp around a BOP stack to enable lifting and/or maneuvering of the BOP stack through connection to the clamp, the method comprising the steps of: a) positioning a first clamp half around one side of the BOP stack; b) positioning a second clamp half around the other side of the BOP stack; c) pushing the two clamp halves together to connect male and female connectors located on each clamp half; and d) connecting locking connectors on each clamp half together to secure the clamp halves together around the BOP stack.

In the method steps a) and b), the clamp halves may be put into position using a lifting line attached to each clamp half. In between steps a) and b), the first clamp half may be stabilized in position by attaching a stabilizing line between the first clamp half and the BOP stack, and the lifting line may be disconnected from the first clamp half and reconnected to the second clamp half.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

Figure 1:
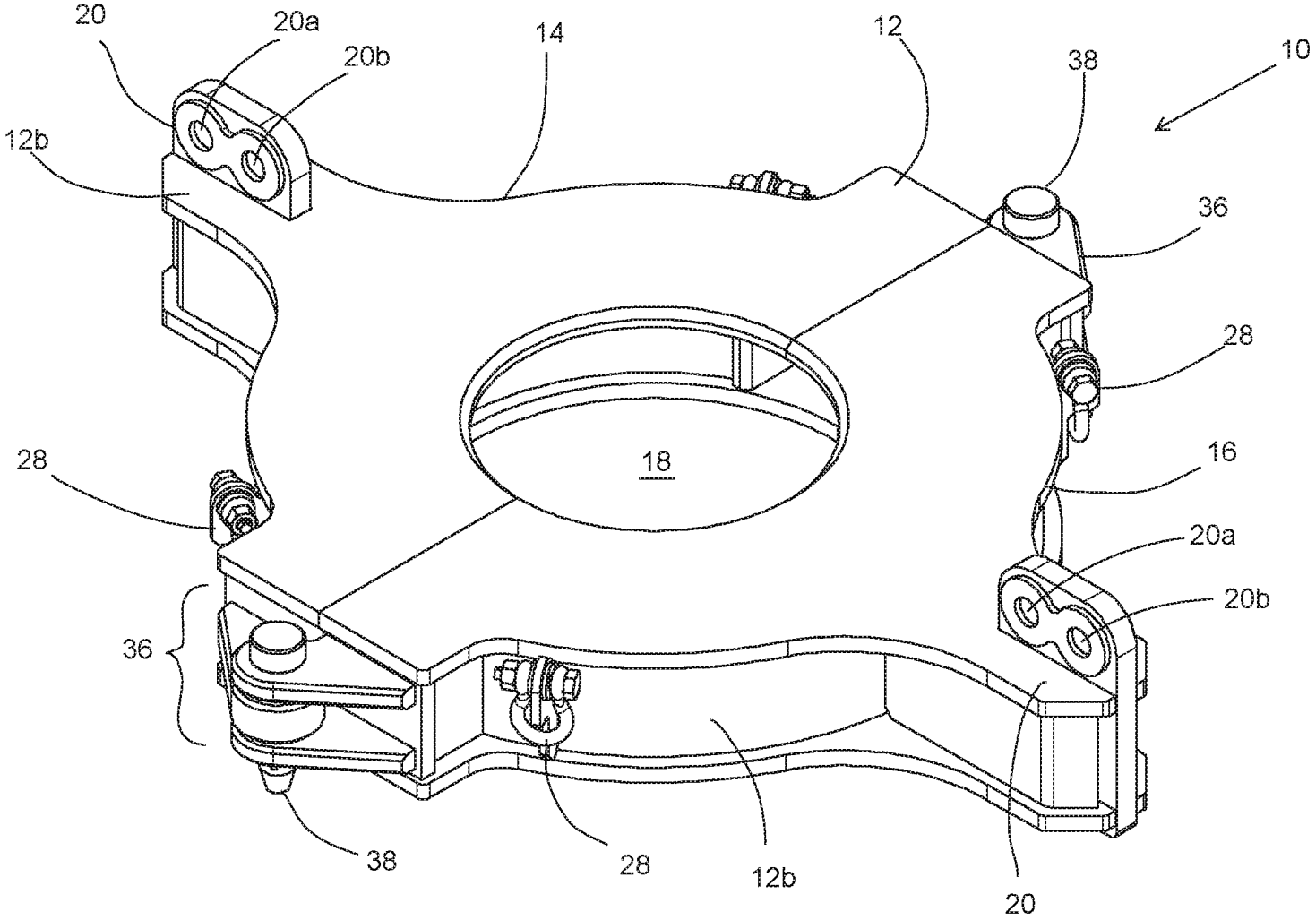
FIG. 1 is a top perspective view of an assembled BOP clamp.
Figure 8:
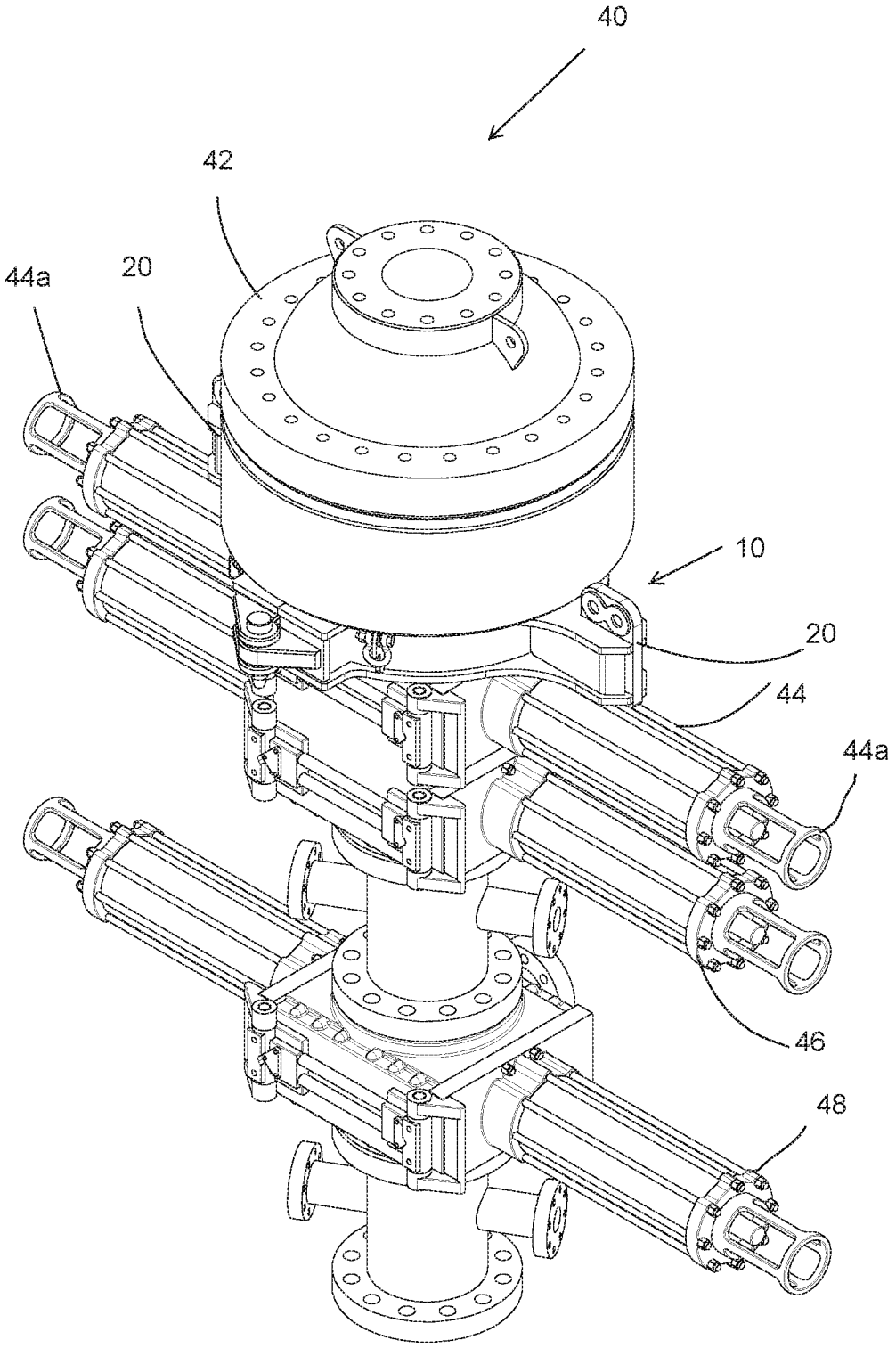
FIG. 8 is a top perspective of a BOP clamp secured to a BOP stack.
Figure 10:
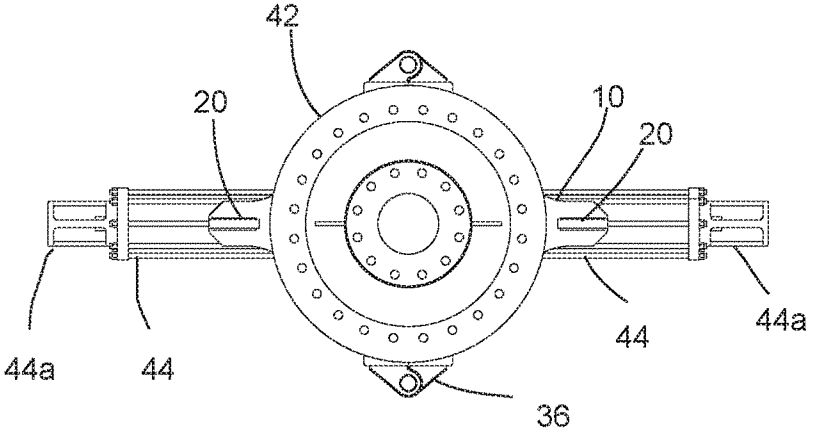
FIG. 10 is a top plan view of the BOP clamp and BOP stack of FIG. 8.
Figure 9:
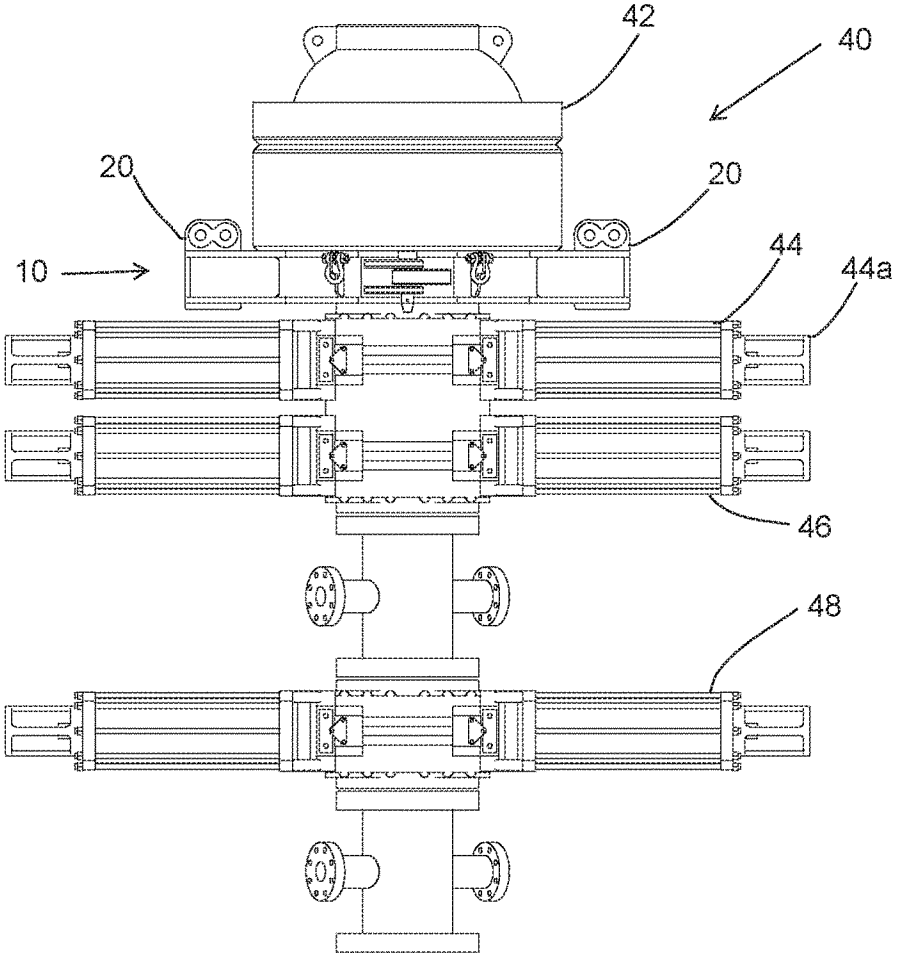
FIG. 9 is a front elevational view of the BOP clamp and BOP stack of FIG. 8.

With reference to the figures, a BOP clamp 10 is described. Referring to FIG. 1, the BOP clamp 10 comprises a body 12 made of a first clamp half 14 and a second clamp half 16 with an opening 18 in the center for accommodating a BOP stack. The BOP clamp fits around a BOP stack 40, as shown in FIGS. 8 to 10, preferably below an annular BOP 42 and above one or more RAM BOPs 44, 46, 48. The BOP clamp provides an attachment mechanism for attaching the BOP stack to a BOP lifting or handling system, such as a crane or a tugger winch. The BOP clamp 10 supports the load of the BOP stack during maneuvering of the stack, particularly during lifting and lowering operations of the BOP stack onto a wellhead.

Connection of the Clamp Halves

Figure 2B:
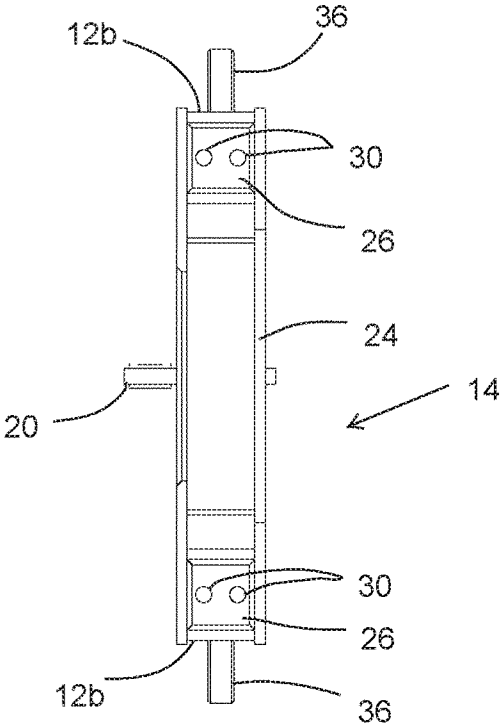
FIG. 2B is a front elevational view of the first half of the unassembled BOP clamp of FIG. 2A.
Figure 2C:
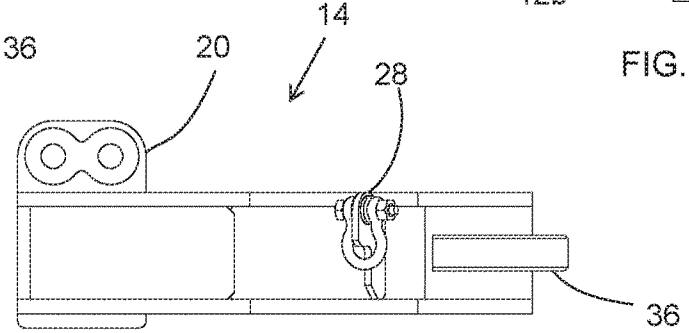
FIG. 2C is a side elevational view of the first half of the unassembled BOP clamp of FIG. 2A.
Figure 2A:
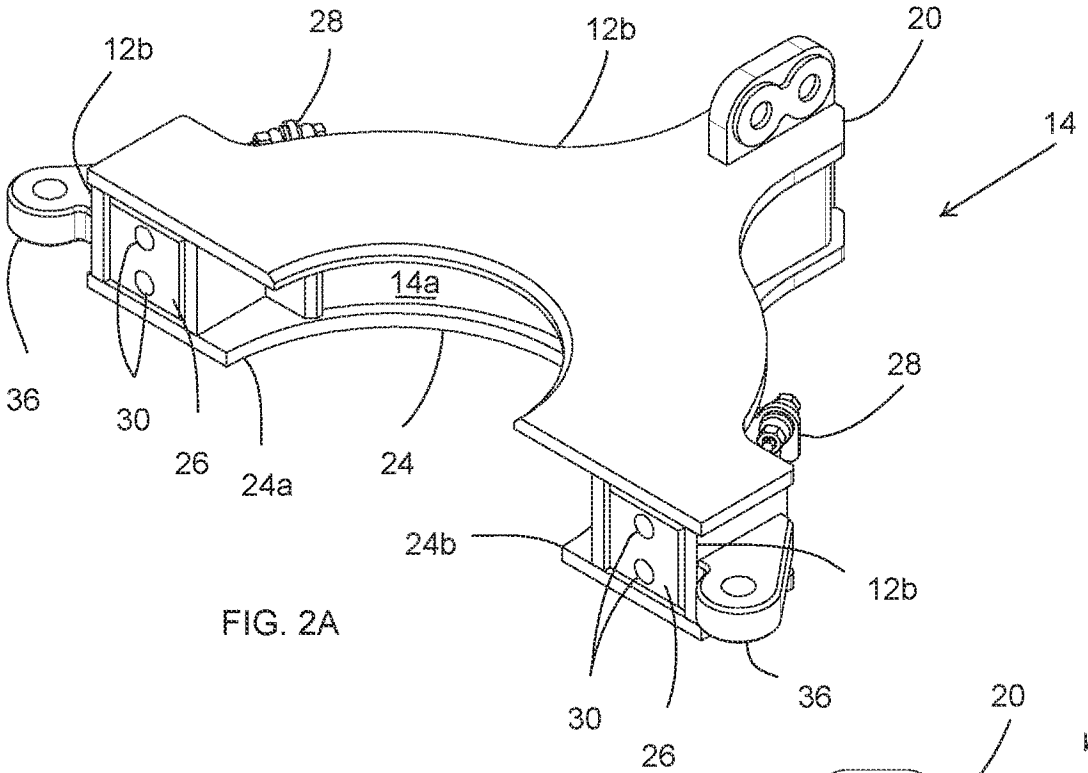
FIG. 2A is a top perspective view of a first half of the unassembled BOP clamp of FIG. 1.
Figure 3B:
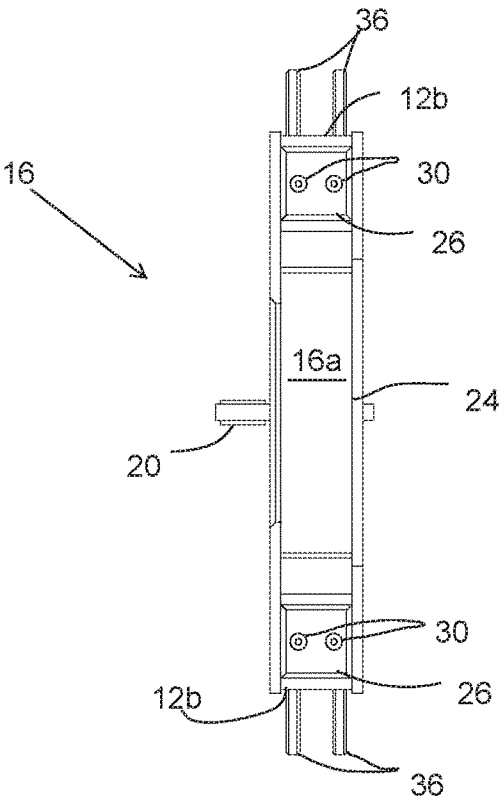
FIG. 3B is a front elevational view of the second half of the unassembled BOP clamp of FIG. 3A.
Figure 3C:
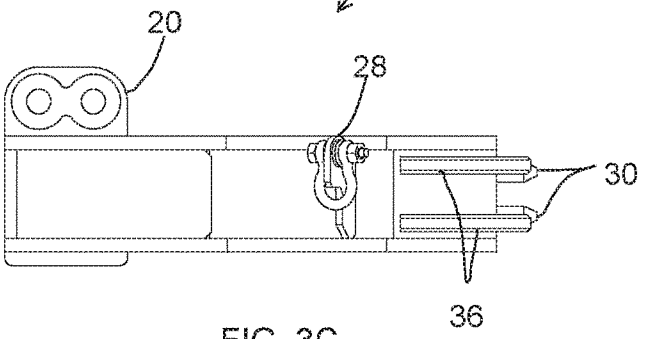
FIG. 3C is a side elevational view of the second half of the unassembled BOP clamp of FIG. 3A.
Figure 3A:
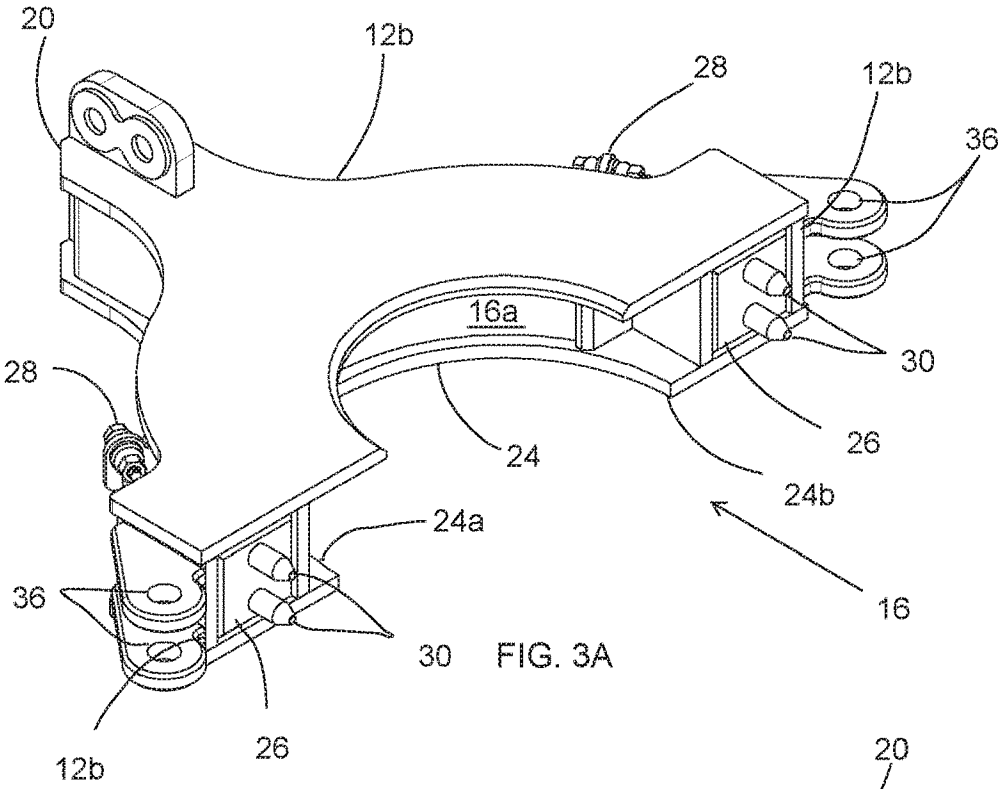
FIG. 3A is a top perspective view of a second half of the unassembled BOP clamp of FIG. 1.

FIGS. 2A, 2B, and 2C illustrate the first clamp half 14 and FIGS. 3A, 3B and 3C illustrate the second clamp half 16 of the BOP clamp 10. Each clamp half 14, 16 comprises an inner surface 14*a*, 16*a* having a generally arcuate recess 24 flanked by planar inner mating surfaces 26. The inner mating surfaces 26 preferably extend from the ends 24*a*, 24*b* of the recess to the outer edges 12*b* of the BOP clamp.

Male-Female Connectors

The inner mating surfaces 26 of the first clamp half 14 abut against the inner mating surfaces 26 of the second clamp half 16 when the clamp 10 is assembled. Each inner mating surface includes at least one female or male connector 30 which mates with a corresponding female or male connector 30 on an opposing inner mating surface of the other clamp half. The female and male connectors may be dowel pinholes and dowels, respectively, as shown in FIGS. 2A to 3C. Alternatively, the female and male connectors may be a mortise and tenon, a biscuit shaped connector and hole, or another type of male and female joint.

In some embodiments as illustrated in FIGS. 2A to 3C, the male and female connectors 30 comprise two dowel pins (see FIGS. 3A to 3C) and two dowel pinholes (see FIGS. 2A to 2C) located vertically adjacent to each other on each inner mating surface 26. In other embodiments, each clamp half includes a mixture of male and female connectors. For example, one inner mating surface on each clamp half may include one or more female connectors, while the other inner mating surface includes one or more male connectors. Alternatively, each inner mating surface may include a combination of male and female connectors, such as one male connector and one female connector.

Locking Connectors

The first and second clamp halves 14, 16 also include locking connectors 36 for securing the first and second clamp halves to each other. The locking connectors are preferably located adjacent or near the inner mating surfaces 26 of the clamp halves. Preferably, on at least one of the clamp halves, the locking connectors extend outwardly from the clamp half to connect to a corresponding connector on the other clamp half. In some embodiments, the locking connectors 36 comprise lugs that extend outwardly from the outer edges 12*b* of each of the clamp halves, as shown in FIGS. 1 to 7. The lugs 36 on the first body half 14 align with the lugs 36 on the second clamp half 16, to create a continuous hole through which a retainer pin 38 can be inserted to fasten the body halves together to form the clamp 10. In the illustrated embodiments, the second clamp half 16 includes two lugs on each side that align with one lug on each side of the first clamp half 14, however a different number of lugs may be used, as well as a different type of locking connector besides lugs. For example, lugs could extend outwardly from one of the clamp halves and align with holes located in the other clamp half, and a retainer pin could be inserted through the lugs and hole to secure the clamp halves together.

The combination of the male and female connectors 30 and the locking connectors 36 provide a strong clamp that can resist various types of loads placed on the clamp and resist bending. The male and female connectors 30 are preferably positioned in a generally horizontal manner to prevent the two clamp halves from moving on a vertical plane with respect to each other and to resist shear forces acting on the clamp, particularly vertical shear forces but also horizontal shear forces. The locking connectors 36 preferably comprise a vertical retainer pin 38 which can support the tensile load imparted on the clamp by the weight of the clamp and BOP stack during lifting and lowering operations to prevent the clamp halves from separating from each other.

Figures 4, 5, 6, 7:
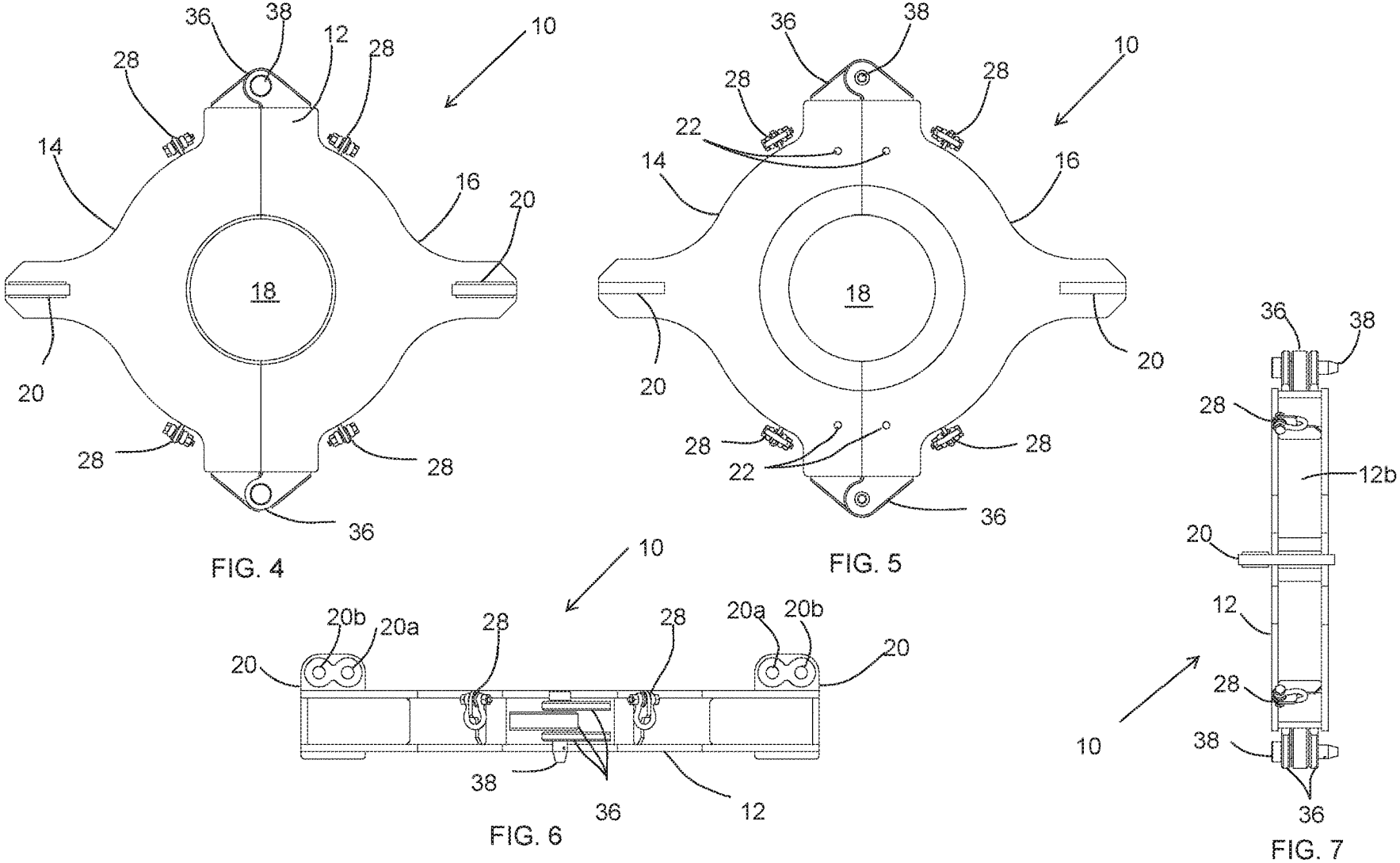
FIG. 4 is a top plan view of the assembled BOP clamp of FIG. 1.
FIG. 5 is a bottom plan view of the assembled BOP clamp of FIG. 1.
FIG. 6 is a side elevational view of the assembled BOP clamp of FIG. 1.
FIG. 7 is an end view of the assembled BOP clamp of FIG. 1.

Each clamp half may also include drain holes 22, as shown in FIG. 5, on the bottom surface 12*c* of the clamp for draining any moisture that may collect in the clamp.

Connection of the Clamp and Clamp Halves to a Lifting Device

The clamp 10 includes connection points for connecting the clamp and/or clamp halves 14, 16 to a lifting device or handling system. The connection points may be used for lifting and moving each clamp half into or out of place around the BOP stack 40, as well as lifting and moving the entire clamp and BOP stack when the clamp is secured around the BOP stack. The same connection points may be used for moving each clamp half and for moving the clamp and BOP stack as a whole, or there may be different connection points for moving each clamp half than for moving the clamp and BOP stack as a whole.

The embodiments illustrated in FIGS. 1 to 7 include different connectors for moving each clamp half and for moving the clamp and BOP stack as a whole. The illustrated embodiments include primary connectors 20 for moving the clamp and BOP stack as a whole, and secondary connectors 28 for moving each clamp half.

Primary Connectors

Referring to FIGS. 1 to 7, the BOP clamp 10 includes primary connectors 20 having suitable attachment points 20*a*, 20*b* located at or near the outer edge 12*b* of the body for attaching the BOP clamp to the BOP lifting or handling system. Preferably, each primary connector includes more than one attachment point as a safety measure, i.e. to provide a back-up attachment point in case of failure of one attachment point or equipment attached to the attachment point (e.g. a chain). The attachment points may be one or more eyelets, as shown in the illustrated embodiments, into which a shackle or similar device may be connected. The primary connectors are shown in the figures as extending outwardly and upwardly from the clamp body 12, however they may be positioned in a different manner that allows for suitable connection of the lifting/handling system to the clamp.

While two primary connectors are shown in the figures, there may be another number of primary connectors, preferably two or more. The primary connectors are preferably spaced evenly around the clamp such that the load of the clamp and BOP stack is evenly distributed between the primary connectors in order to keep the clamp and BOP stack level during lifting and/or maneuvering of the clamp and BOP stack. If there are two primary connectors as illustrated in FIG. 1, they are preferably located directly opposite each other on the clamp.

Secondary Connectors

In some embodiments, the BOP clamp 10 also includes secondary connectors 28 for lifting and maneuvering the clamp halves 14, 16 when the clamp is disassembled. The secondary connectors 28 are preferably located at or near the outer edge 12*b* of the clamp body 12. Preferably, each clamp half includes at least two secondary connectors 28, as shown in FIGS. 1 to 7, which allows two lifting lines to be attached to each clamp half to be able to lift and maneuver the clamp half while keeping the clamp half level. The secondary connectors are preferably positioned around the clamp half such that the load of the clamp half is distributed evenly between the secondary connectors to keep the clamp half generally level during movement. The secondary connectors may be eyelets, lugs, D-rings, shackles, and/or any other suitable connectors that allow for connection to a lifting device.

Alternative Connectors

While the figures illustrate both primary connectors 20 and secondary connectors 28, as stated above the same connectors can be used for moving the clamp and BOP stack as for moving the clamp halves. For example, the clamp may include four connectors spaced around the clamp, with two connectors on each clamp half. To move a clamp half on its own, the two connectors on the clamp half would be used. To move the clamp and BOP stack as a whole, all four connectors could be used, or only two connectors on opposing sides of the clamp could be used.

Lifting Adaptors

Figure 11:
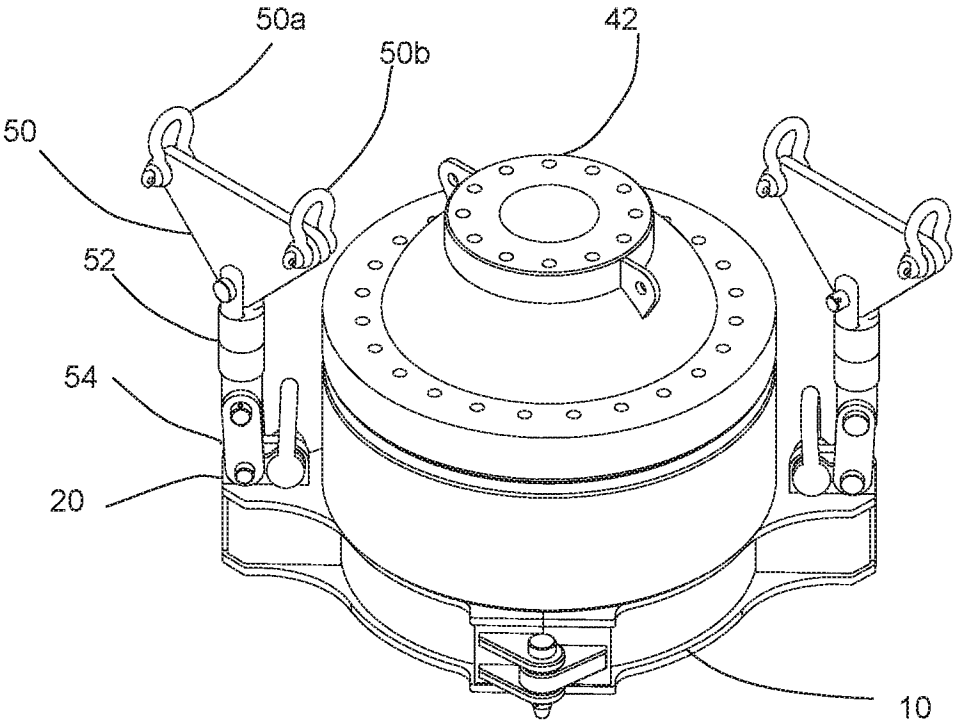
FIG. 11 is a top perspective view of a BOP clamp having a lifting adaptor, with the BOP clamp positioned around an annular BOP.
Figure 12:
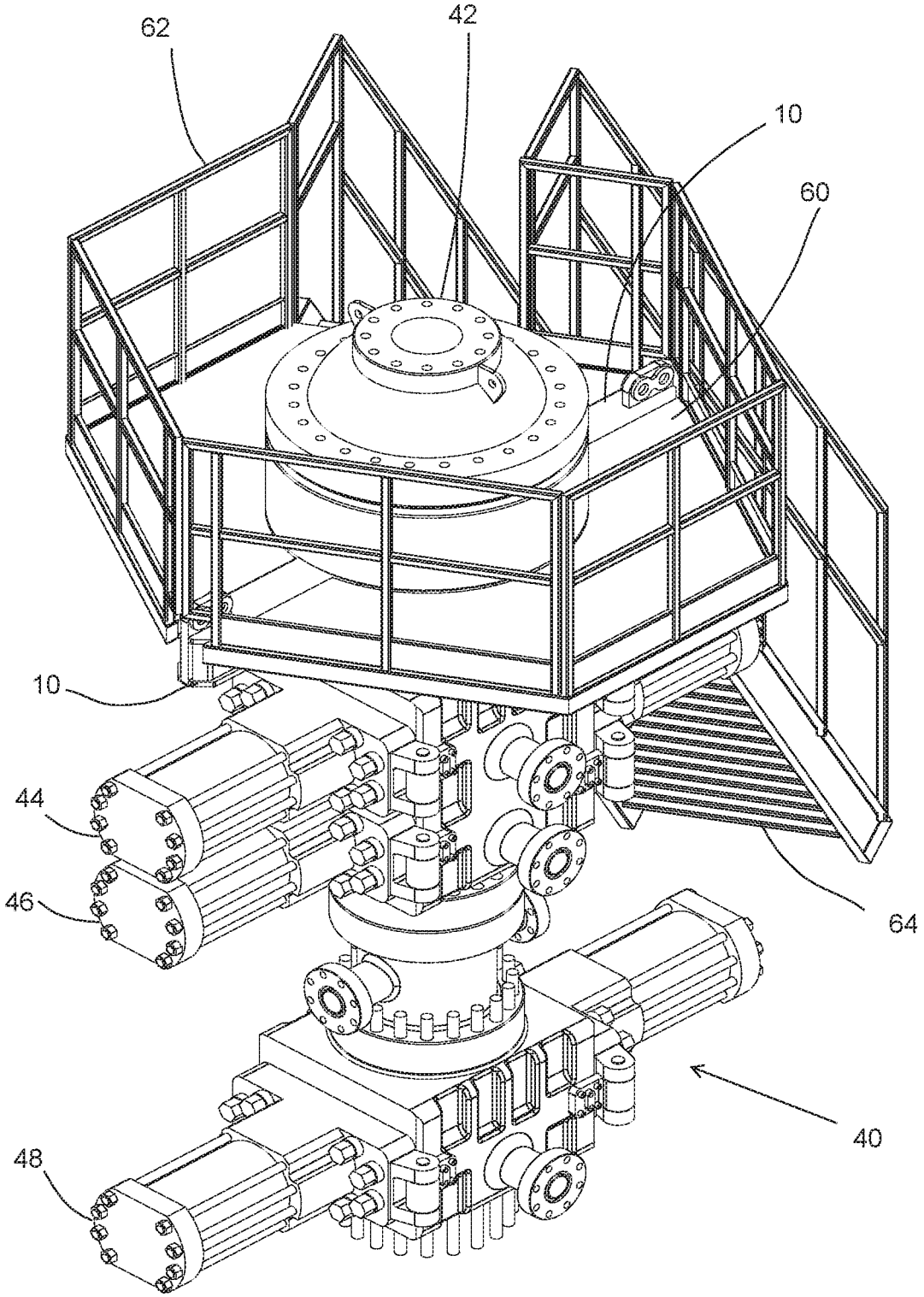
FIG. 12 is a top perspective view of a BOP clamp on a BOP stack with a platform for accessing the BOP stack.

A lifting adaptor may be connected to the connection points, including the primary connectors 20 and/or the secondary connectors 28 to change the angle, location, and/or number of connection points on the clamp. The lifting adaptor may include a swivel device and/or a pivotable link. An example of a lifting adaptor 50 is shown in FIG. 11 that provides additional attachment points 50*a*, 50*b*, to allow four-point attachment to the primary connectors 20 of the BOP clamp 10. The illustrated lifting adaptor also includes a swivel device 52 and a pivoting linking plate 54 for accommodating different connection angles between the primary connectors and the lifting device.

Assembling the BOP Clamp

Figure 13A:
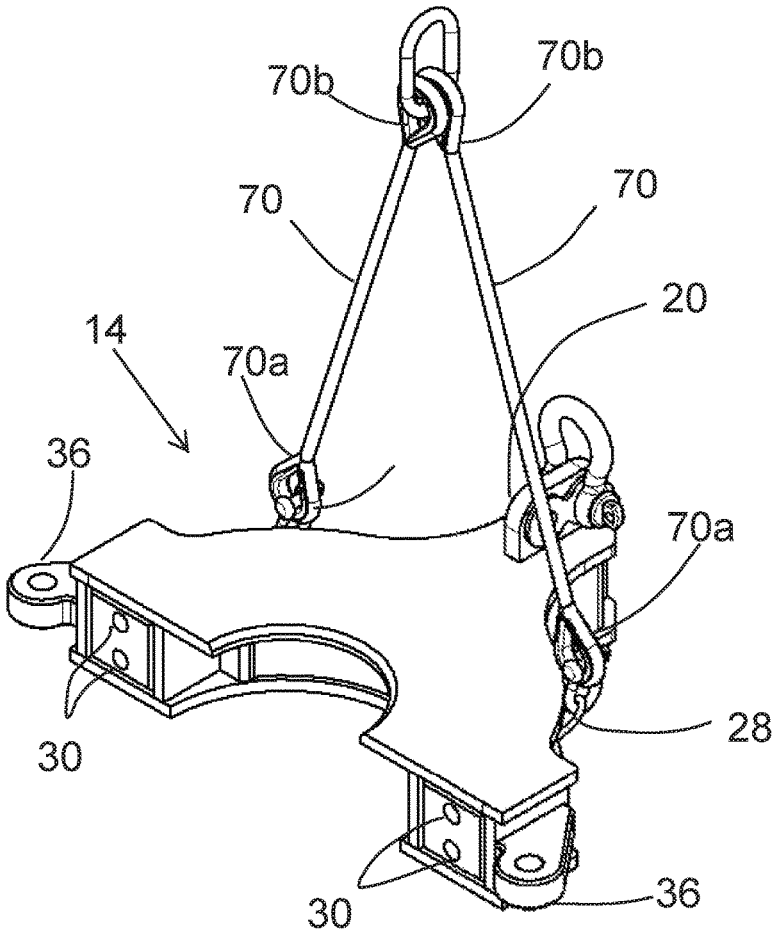
FIG. 13A is top front perspective view of a first half of the BOP clamp being lifted.
Figure 13B:
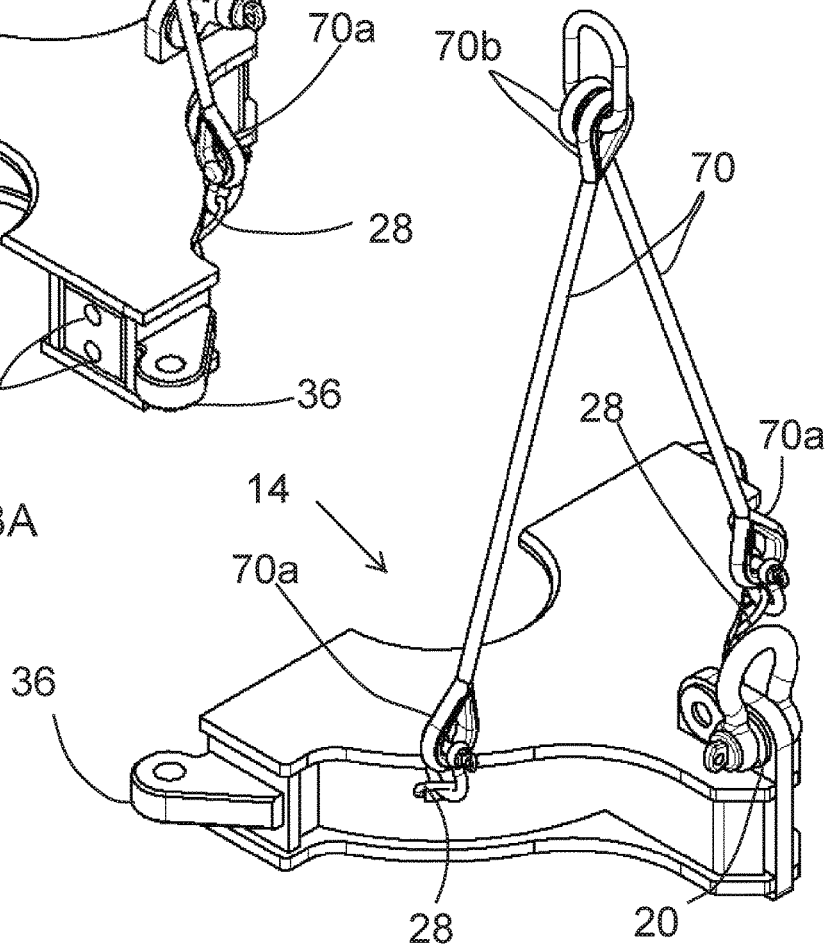
FIG. 13B is a top side perspective view of the one half of the BOP clamp of FIG. 13A being lifted.

The BOP clamp can be attached to a BOP stack without disassembling or partially disassembling the BOP stack. The method for assembling the BOP clamp 10 is shown in FIGS. 13A, 13B, 14A, 14B and 14C. As shown in FIGS. 13A and 13B, first ends 70*a* of lifting lines 70 are attached to each of the secondary connectors 28 on the first clamp half 14. Second ends 70*b* of the lifting lines are connected to a lifting device (not shown), e.g. a crane or tugger winch. The lifting device is used to position the first clamp half 14 around the BOP stack 40, as shown in FIG. 14A.

Next, the first clamp half 14 is stabilized in place around the BOP stack. In some embodiments, the first clamp half is stabilized by connecting the primary connector 20, preferably with a shackle 20*d* and a stabilizing line 72, such as a wire rope or chain, to an annular lug 42*a* near the top of the annular BOP 42 as shown in FIG. 14B. The first clamp half 24 can also be stabilized using other means and/or connection points on the first clamp half or BOP stack. After the first clamp half is stabilized, the lifting line is disconnected from the first clamp half 14 and connected to the second clamp half 16. The second clamp half is then maneuvered into place around the BOP stack in the same manner as was done for the first clamp half, as shown in FIG. 14B.

After both clamp halves are positioned in place around the BOP stack, the clamp halves are pushed together to mate the male and female connectors 30 from each clamp half together. This is generally done using hand tools such as a sledge hammer and/or pry bar. This also aligns the locking connectors 36 of each clamp half with each other, allowing the locking connectors to be connected together. In the embodiment shown in FIG. 14C, the locking connectors are connected by inserting a retainer pin 38 through each set of locking connectors on either side of the clamp. The lifting lines 70 and stabilizing line 72 can then be removed since the clamp is now securely supported and connected around the BOP stack 40.

Now, the BOP clamp can be used to lift and maneuver the BOP stack 40 by attaching lifting lines to the primary connectors 20.

As described previously, the BOP clamp is not limited to including two primary connectors 20 and four secondary connectors 28. For example, the same connectors may be used for moving each clamp half and for moving the clamp and BOP stack as a whole. If this is the case, the described method for assembling the BOP clamp is modified to accommodate the number, type and location of the connection points.

Figure 14C:
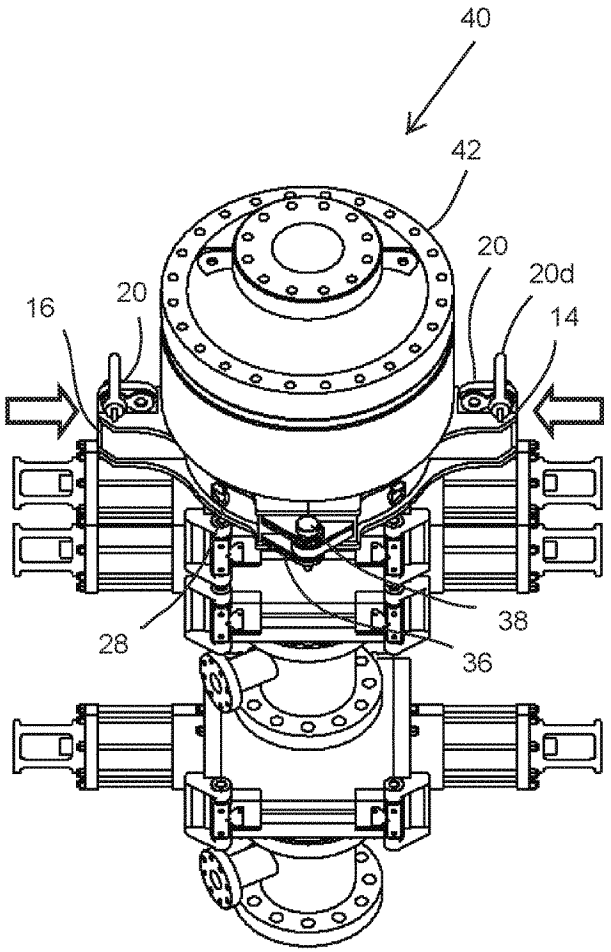
FIG. 14C is a top perspective view of the first and second halves of the BOP clamp connected together around a BOP stack.
Figure 14B:
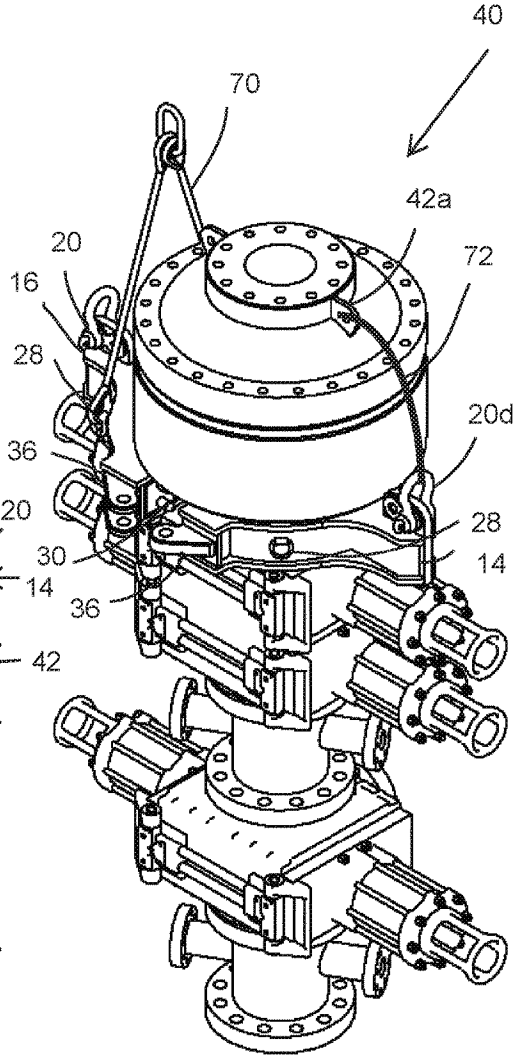
FIG. 14B is a top front perspective view of a second half of the BOP clamp being positioned around a BOP stack.
Figure 14A:
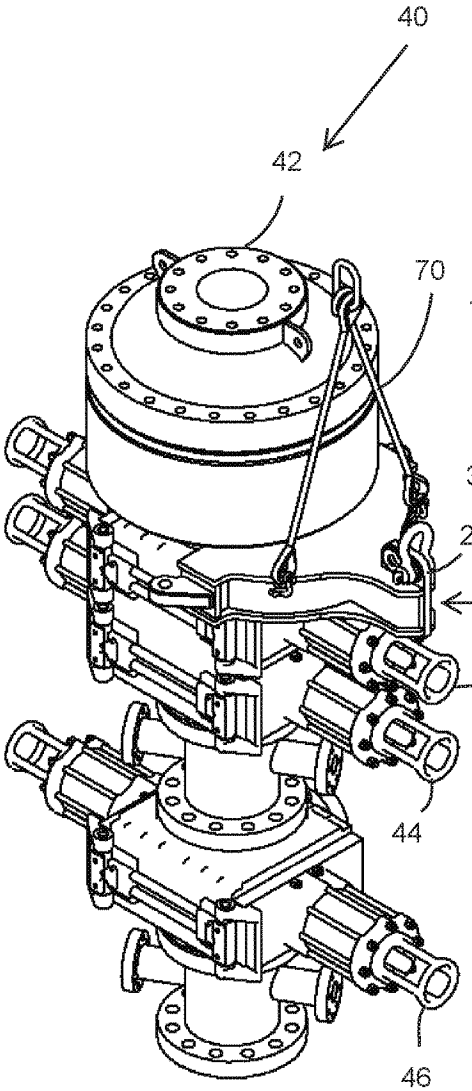
FIG. 14A is a top front perspective view of a first half of the BOP clamp being positioned around a BOP stack.

The BOP clamp is preferably designed such that it can be installed below a top annular BOP 42 in a BOP stack without having to remove the annular BOP, as shown in FIGS. 14A to 14C. The BOP is also preferably designed such that it does not interfere with parts of the BOP stack, such as hydraulic and/or electrical lines. As shown in FIGS. 8 to 10, the primary connectors 20 extend beyond the outer edge of the annular BOP 42 such that lifting lines can be secured to the primary connectors without interfering with the annular BOP. Preferably, the BOPs below the BOP clamp 10, such as RAM BOPs 44, 46, 48, have attachment areas 44*a* that extend beyond the outer edge of the BOP clamp 10, such that any lines attached to the RAM BOPs can extend upwards without the BOP clamp 10 interfering with the path of the lines.

Specifications

The BOP clamp can be manufactured to accommodate various sizes and weights of BOP stacks. Commonly used annular BOPs range from 9" to 14" in diameter, which various sizes of the BOP clamp can accommodate. When the BOP clamp is being supported by the primary connectors 20, it can typically accommodate a load rating of 5 to 60 tons (10,000 to 120,000 lbs) depending on the size of the clamp, shackle and lifting line.

Walk Around

The BOP clamp 10 may also include a platform 60 that can be attached to the BOP clamp to allow workers to access the BOP stack 40 for servicing the BOP stack. Preferably, the platform 60 extends around the outer perimeter of the top annular BOP 42 and includes removable handrails 62 for safety reasons. A staircase or ramp 64 connects to the platform to allow access to the platform.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A clamp for attachment to a blow out preventer (BOP) stack for lifting and/or maneuvering the BOP stack, the clamp comprising:

a first clamp half and a second clamp half for operative connection to each other to form the clamp, each clamp half having an inner edge with a generally arcuate recess and an inner mating surface adjacent each side of the generally arcuate recess, wherein the generally arcuate recess and inner mating surfaces of each clamp half align opposing each other to form an opening in the clamp for enclosing the BOP stack, wherein each clamp half has an upper surface for supporting an upper component of the BOP stack and distributing the weight of the BOP stack across the clamp, wherein each clamp half includes:

at least one male or female connector at each inner mating surface for joining with the at least one male or female connector at the opposing inner mating surface of the other clamp half;

at least one locking connector located near each inner mating surface, wherein the locking connectors of the clamp halves align with each other to form a hole having an axis oriented parallel with a through axis of the clamp opening for receiving a fastener to secure the clamp halves together; and at least two connection points on each clamp half for operative connection to a lifting device for lifting and/or maneuvering each clamp half and/or the clamp and BOP stack;

wherein each of the aligned inner mating surfaces includes a male connector of the at least one male or female connector joined with a female connector of the at least one male or female connector, and the longitudinal axes of the male connectors and the female connectors are oriented perpendicular to the through axis of the clamp opening.

2. The clamp as in claim 1, wherein the male and female connectors are dowel pins and dowel pinholes, respectively.

3. The clamp as in claim 2, wherein each dowel pin has a free end extending from the inner mating surface and an opposite end that does not extend to and beyond an outer surface of the clamp half.

4. The clamp as in claim 2, wherein each dowel pinhole has an open end at the inner mating surface and an opposite closed end that does not extend to and beyond an outer surface of the clamp half.

5. The clamp as in claim 1, wherein the locking connectors are lugs, and the clamp further comprises two retainer pins, the retainer pins being the fasteners for insertion into the hole formed by the lugs for securing the lugs of each clamp half together.

6. The clamp as in claim 5, wherein the lugs are projections extending from an outer surface of the clamp half perpendicular to the through axis of the clamp opening.

7. The clamp as in claim 1, wherein the at least two connection points comprise a primary connector extending from a top surface of each clamp half for use during lifting and maneuvering of the clamp and BOP stack when the clamp is secured around the BOP stack.

8. The clamp as in claim 1, wherein the at least two connection points comprise at least two secondary connectors extending from an outer side surface of each clamp half for use during lifting and maneuvering of each clamp half when it is not secured to the other clamp half.

9. The clamp as in claim 8, wherein the at least two secondary connectors are positioned on each clamp half to allow for generally even distribution of the weight of each clamp half between the at least two secondary connectors.

10. The clamp as in claim 1, further comprising a lifting adaptor connected to at least one of the at least two connection points for changing an angle and/or position of connection.

11. The clamp as in claim 10, wherein the lifting adaptor comprises a swivel device.

12. The clamp as in claim 10, wherein the lifting adaptor comprises a pivotable link.

13. The clamp as in claim 1, further comprising a platform for removable connection to the clamp for accessing the BOP stack when the clamp and platform are connected.

14. The clamp as in claim 13, further comprising a staircase or ramp connected to the platform.

15. The clamp of claim 1, wherein at least the first clamp half or at least the second clamp half includes one or more drain holes in its bottom surface.

16. The clamp as in claim 1, wherein the upper component of the BOP stack is an annular BOP.

17. The clamp as in claim 1, wherein the upper surface of each clamp half for supporting the upper component of the BOP extends above the male and female connectors such that the weight of the BOP stack is distributed on the upper surface above the male and female connectors.

18. The clamp as in claim 1, wherein the fastener is a one-piece fastener that does not require a second piece to secure the clamp halves together.

19. A method for attaching the clamp of claim 1 around a BOP stack to enable lifting and/or maneuvering of the BOP stack through connection to the clamp, the method comprising the steps of:

a) positioning the first clamp half around one side of the BOP stack;

b) positioning the second clamp half around the other side of the BOP stack;

c) pushing the two clamp halves together to connect the male connectors and the female connectors to join the inner mating surfaces of the clamp halves d) aligning the locking connectors of the clamp halves; and e) inserting the fastener through the hole formed by the aligned locking connectors to secure the clamp halves together around the BOP stack.

20. A clamp for attachment to a blow out preventer (BOP) stack for lifting and/or maneuvering the BOP stack, the clamp comprising:

a first clamp half and a second clamp half for operative connection to each other to form the clamp, each clamp half having an inner edge with a generally arcuate recess and an inner mating surface adjacent each side of the generally arcuate recess, wherein the generally arcuate recess and inner mating surfaces of each clamp half align opposing each other to form an opening in the clamp for enclosing the BOP stack, wherein each clamp half has an upper surface for supporting an upper component of the BOP stack and distributing the weight of the BOP stack across the clamp, wherein each clamp half includes:

at least one dowel pin or dowel pinhole at each inner mating surface for joining with the at least one dowel pin or dowel pinhole at the opposing inner mating surface of the other clamp half, wherein the longitudinal axes of the dowel pins and dowel pinholes are oriented perpendicular to a through axis of the clamp opening, wherein each dowel pin has a free end extending from the inner mating surface and an opposite end of the dowel pin does not extend to and beyond an outer surface of the clamp half, wherein each dowel pinhole has an open end at the inner mating surface and an opposite closed end that does not extend to and beyond the outer surface of the clamp half;

at least one locking connector comprising a lug located near each inner mating surface, wherein the lugs of the clamp halves align with each other to form a hole having an axis oriented parallel with the through axis of the clamp opening for receiving a retainer pin to secure the clamp halves together; and at least two connection points on each clamp half for operative connection to a lifting device for lifting and/or maneuvering each clamp half and/or the clamp and BOP stack;

wherein each of the aligned inner mating surfaces includes a dowel pin of the at least one dowel pin or dowel pinhole joined with a dowel pinhole of the at least one dowel pin or dowel pinhole.

* * * * *